US006663355B2

(12) United States Patent
Kubo et al.

(10) Patent No.: US 6,663,355 B2
(45) Date of Patent: Dec. 16, 2003

(54) VARIABLE DISPLACEMENT COMPRESSOR

(75) Inventors: Hiroshi Kubo, Kariya (JP); Tetsuhiko Fukanuma, Kariya (JP); Masakazu Murase, Kariya (JP); Osamu Nakayama, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 94 days.

(21) Appl. No.: 09/894,535

(22) Filed: Jun. 28, 2001

(65) Prior Publication Data

US 2002/0018722 A1 Feb. 14, 2002

(30) Foreign Application Priority Data

Jun. 28, 2000 (JP) ..... 2000-194658

(51) Int. Cl.[7] ..... F04B 1/21
(52) U.S. Cl. ..... 417/222.2; 417/269
(58) Field of Search ..... 417/269, 222.2, 417/313, 222.1, 270

(56) References Cited

U.S. PATENT DOCUMENTS 5,584,670 A 12/1996 Kawaguchi et al.
5,616,008 A 4/1997 Yokono et al.
5,699,716 A * 12/1997 Ota et al. ..... 92/12.2
5,785,502 A * 7/1998 Ota et al. ..... 417/222.2
5,941,161 A * 8/1999 Kimura et al. ..... 92/155
5,953,980 A * 9/1999 Ota et al. ..... 92/71
6,010,313 A * 1/2000 Kimura et al. ..... 417/222.2
6,015,269 A * 1/2000 Ota et al. ..... 417/222.2
6,102,669 A 8/2000 Fujita
6,398,515 B1 * 6/2002 Yokomachi et al. ..... 417/201

FOREIGN PATENT DOCUMENTS

EP 0 902 205 A2 3/1999
JP 11-062824 3/1999

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

A variable displacement compressor includes a housing having a suction chamber. A crank chamber is defined in the housing. A valve plate assembly is located in the housing. A drive shaft is supported in the housing. A radial bearing is located in the housing. A holding bore houses the rear end of the drive shaft and the radial bearing. The holding bore is connected to a holding space. A passage connects the holding space and the suction chamber. A restricting member is located in the holding space. The restricting member restricts axial movement of the drive shaft and divides the holding space into a first region and a second region. A clearance is formed between the restricting member and the valve plate assembly. The clearance disappears when the pressure of the crank chamber is increased rapidly.

14 Claims, 5 Drawing Sheets

VARIABLE DISPLACEMENT COMPRESSOR

BACKGROUND OF THE INVENTION

The present invention relates to a variable displacement compressor having single-headed pistons, which is used, for example, in a vehicular air conditioning system.

A variable displacement swash plate clutch compressor shown in FIG. 8 has a solenoid clutch 101, which can interrupt power transmission from a vehicular engine Eg. The compressor also has a displacement control mechanism, which can reduce the displacement so that the solenoid clutch is not be turned on and off frequently when the cooling load is low.

The displacement control mechanism has a swash plate 103 connected to pistons 102 through shoes 102*a*. A rotary support 105 is fixed to a drive shaft 104. The swash plate 103 is connected to the rotary support 105 through a hinge mechanism 106. The swash plate 103 is housed in the crank chamber 107. The differential pressure between the crank chamber 107 and the cylinder bores 18 varies to change the inclination angle of the swash plate 103. As the inclination angle of the swash plate 103 is changed, the stroke of each piston 102 is changed to change the displacement.

For example, when the pressure of the crank chamber 107 is increased to increase the difference between the pressure of the pressures of the cylinder bore 108, the inclination angle of the swash plate 103 is reduced, which reduces the compressor displacement. In FIG. 8, the swash plate 103 indicated by the broken double-dashed line is at the minimum inclination position, where it abuts against a regulating ring 109 attached to the drive shaft 104. When the internal pressure of the crank chamber 107 is reduced to reduce the differential pressure the cylinder bores 108, the inclination angle of the swash plate 103 is increased to increase the compressor displacement.

Generally, in the step of compressing a refrigerant gas, the piston 102, the swash plate 103, the hinge mechanism 106, the rotary support 105 and the drive shaft 104 transmit force to the internal wall surface of a housing 110 (leftward in FIG. 8) through a thrust bearing 111 due to the compression load on the piston 102.

The internal pressure of the crank chamber 107 remains high so that the compressor can be started from the minimum displacement state, at which the load torque is minimized, even if the solenoid clutch is turned on soon after it is turned off. Further, control of the compressor displacement is performed to minimize the displacement, regardless of the cooling load, to reduce load of the engine Eg during rapid acceleration of the vehicle.

When the internal pressure of the crank chamber 107 is increased rapidly to minimize the displacement, the swash plate 103 may be pressed against the regulating ring 109 with excessive force, or the rotary support 105 may be pulled strongly to the rear side of the compressor through the hinge mechanism 106. Thus, the drive shaft 104 is caused to slide or shift backward (rightward in FIG. 8) along the axis L.

Upon such movement of the drive shaft 104, the top dead center position of the piston 102 shifts toward the valve plate 112. Therefore, the piston 102 may impinge upon the valve plate 112 when reaching the top dead center position. This impingement causes vibrations and noise and may damage the pistons 102 or the valve plate 112.

Also, when such backward movement of the drive shaft 104 takes place when the solenoid clutch 101 is turned off, an armature 101*a* of the solenoid clutch 101 moves toward a rotor 101*b* to eliminate a clearance between the armature 101*a* and the rotor 101*b* or to bring the armature 101*a* into contact with the rotor 101*b*, which causes rattling or vibration and unnecessary power transmission.

To solve the above problems, a spring 113 is located between the housing 110 and the drive shaft 104. The spring 113 urges the drive shaft 104 axially forward.

Japanese Unexamined Patent Publication No. Hei 11-62824 discloses a compressor having a restricting member for restricting axial shifting of the drive shaft. The restricting member is located in a hole in which the rear end of the drive shaft is fitted. The hole communicates with a suction chamber through a space. A sealing member, which prevents communication between a crank chamber and the space through the hole is applied around the rear end of the drive shaft.

To securely prevent backward axial shifting of the drive shaft 104 shown in FIG. 8, it is essential to use a very stiff spring 113. As a result, the thrust bearing 111 receives a great load from the spring 113, which reduces the life of the thrust bearing 111 and increases the power loss of the compressor at the thrust bearing 111. The increased power loss adversely affects the fuel consumption rate of the engine Eg that drives the compressor.

In the compressor disclosed in Japanese Unexamined Patent Publication No. Hei 11-62824, a sealing member is located in the hole in which the rear end of a drive shaft is supported. The sealing member prevents entry of refrigerant into the hole. Therefore, lubricant cannot be supplied fully to the radial bearing, which shortens the life of the bearing.

BRIEF SUMMARY OF THE INVENTION

It is an object of the present invention to provide a variable displacement compressor having a simple constitution and being capable of maintaining sufficient lubrication of the radial bearing.

To achieve the above objective, the present invention provides a variable displacement compressor. The compressor comprises a housing having a suction chamber and a discharge chamber. A crank chamber is defined in the housing. A drive shaft has a front end and a rear end. The shaft is supported in the housing so that the front end protrudes from the housing. A cylinder block forms part of the housing. Cylinder bores are defined in the cylinder block. A valve plate assembly includes a suction port, a suction valve, a discharge port and a discharge valve for each cylinder bore. Single-headed pistons are housed in the cylinder bores, respectively. A drive plate is housed in the crank chamber and is connected to the pistons to convert rotation of the drive shaft into reciprocating motion of the pistons. The drive plate rotates integrally with the drive shaft. A control mechanism controls inclination of the drive plate by controlling the pressure of the crank chamber to change the volume of a refrigerant discharged from each cylinder bore into the discharge chamber. A radial bearing supports the rear end of the drive shaft. The refrigerant flows through the radial bearing. A holding bore houses the rear end of the drive shaft and the radial bearing. The holding bore is connected to a holding space. The holding space is defined by the valve plate assembly. A passage connects the holding space and the suction chamber. A restricting member is located in the holding space. The restricting member restricts axial movement of the drive shaft and divides the holding space into a first region and a second region. The first region and the second region communicate with each other. A clearance is formed between the drive shaft and the restricting member or between the restricting member and the valve plate assembly in a normal compressing operation. The clearance disappears when the pressure of the crank chamber is increased rapidly by the control mechanism.

The present invention also provides a variable displacement compressor. The compressor comprises a housing having a suction chamber and a discharge chamber. A crank chamber is defined in the housing. A drive shaft has a front end and a rear end. The shaft is supported in the housing so that the front end protrudes from the housing. A cylinder block forms part of the housing. Cylinder bores are defined in the cylinder block. A valve plate assembly includes a suction port, a suction valve, a discharge port and a discharge valve for each cylinder bore. Single-headed pistons are housed in the cylinder bores, respectively. A drive plate is housed in the crank chamber and is connected to the pistons to convert rotation of the drive shaft into reciprocating motion of the pistons. The drive plate rotates integrally with the drive shaft. A control mechanism controls inclination of the drive plate by controlling the pressure of the crank chamber to change the volume of a refrigerant discharged from each cylinder bore into the discharge chamber. A radial bearing supports the rear end of the drive shaft. The refrigerant flows through the radial bearing. A holding bore houses the rear end of the drive shaft and the radial bearing. The holding bore is connected to a holding space. The holding space is defined by the valve plate assembly. The holding space is connected to the suction chamber. Means for restricting restricts axial movement of the drive shaft. The restricting means are located in the holding space and divides the holding space into a first region and a second region. A clearance is formed between the drive shaft and the restricting means or between the restricting means and the valve plate assembly in a normal compressing operation. The clearance disappears when the pressure of the crank chamber is increased rapidly by the control mechanism. A passage connects the first region to the second region.

The present invention also provides a variable displacement compressor. The compressor comprises a housing having a suction chamber and a discharge chamber. A crank chamber is defined in the housing. A drive shaft has a front end and a rear end. The shaft is supported in the housing so that the front end protrudes from the housing. A cylinder block forms part of the housing. Cylinder bores are defined in the cylinder block. A valve plate assembly includes a suction port, a suction valve, a discharge port and a discharge valve for each cylinder bore. Single-headed pistons are housed in the cylinder bores, respectively. A drive plate is housed in the crank chamber and is connected to the pistons to convert rotation of the drive shaft into reciprocating motion of the pistons. The drive plate rotates integrally with the drive shaft. A control mechanism controls inclination of the drive plate by controlling the pressure of the crank chamber to change the volume of a refrigerant discharged from each cylinder bore into the discharge chamber. A radial bearing supports the rear end of the drive shaft. The refrigerant flows through the radial bearing. A holding bore houses the rear end of the drive shaft and the radial bearing. The holding bore is connected to a holding space. The holding space is defined by the valve plate assembly. A passage connects the holding space and the suction chamber. A cylindrical body is located in the holding space. One end of the cylindrical body is fixed to the drive shaft, and the other end of the cylindrical body abuts against the valve plate assembly. The cylindrical body restricts axial movement of the drive shaft and divides the holding space into a first region and a second region. The cylindrical body has a hole to connect the first region to the second region. A clearance is formed between the drive shaft and the cylindrical body or between the cylindrical body and the valve plate assembly in a normal compressing operation. The clearance disappears when the internal pressure of the crank chamber is increased rapidly by the control mechanism.

Other aspects and advantages of the invention will become apparent from the following description, taken in conjunction with the accompanying drawings, illustrating by way of examples the principles of the invention.

BRIEF DESCRIPTION OF THE SEVERAL VIEWS OF THE DRAWING

The invention together with objects and advantages thereof, may best be understood by reference to the following description of the presently preferred embodiments together with the accompanying drawings in which:

FIG. 2(*b*) is an enlarged cross-sectional view showing actions of the passage at the portion shown in FIG. 2(*a*);

FIG. 3(*b*) is a cross-sectional view taken along the line 3*b*—3*b* in FIG. 3(*a*);

FIG. 5(*b*) is a cross-sectional view taken along the line 5*b*—5*b* in FIG. 5(*a*);

FIG. 7(*b*) is an enlarged cross-sectional view of the compressor according to a fifth embodiment of the present invention, showing a portion corresponding to that in FIG. 2(*a*)

DETAILED DESCRIPTION OF THE PREFERRED EMBODIMENTS

The variable displacement compressor according to the first embodiment of the present invention is part of a vehicular air conditioning system and is described below referring to FIGS. 1 and 2(*b*).

Figure 1:
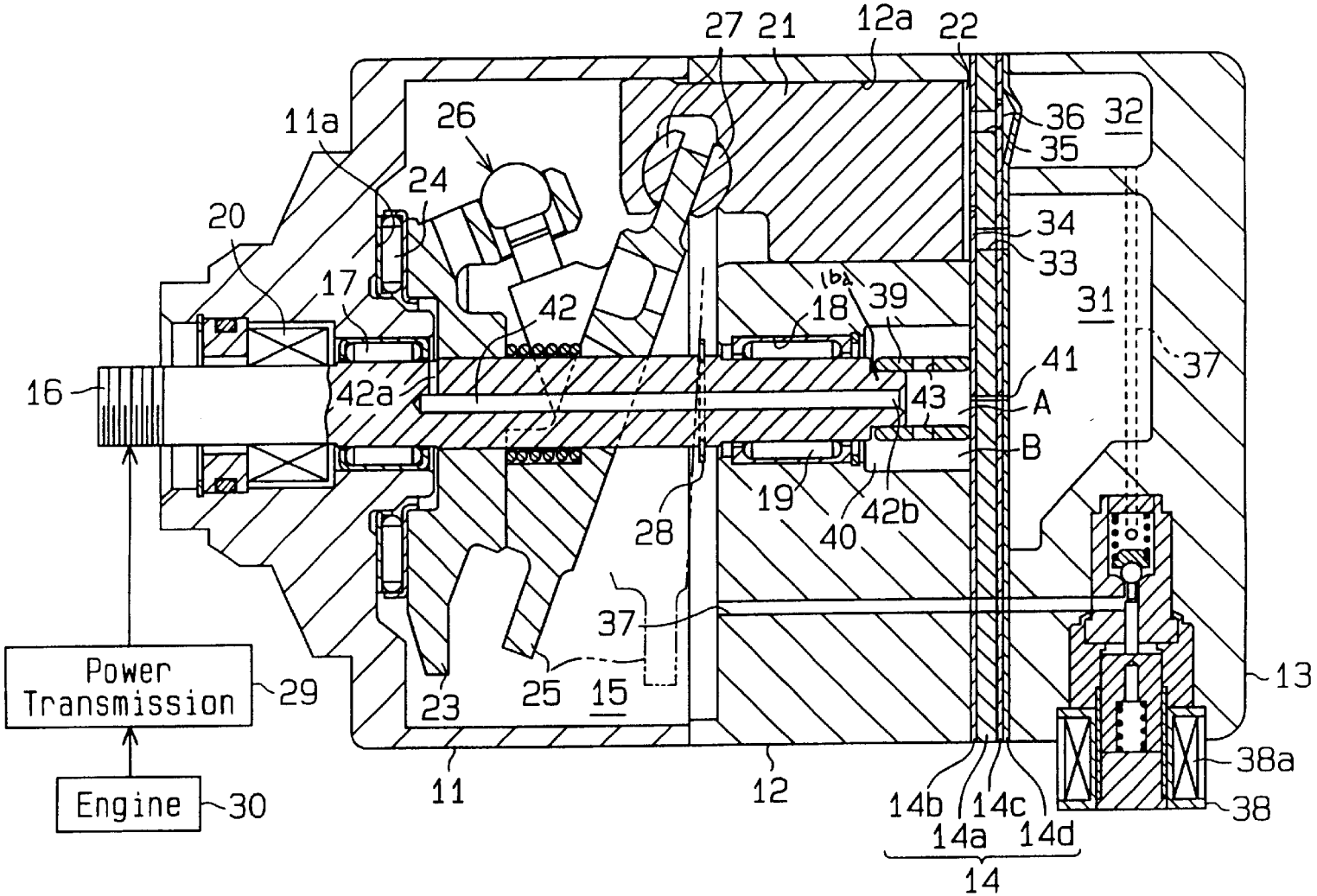
FIG. 1 is a cross-sectional view of the variable displacement compressor according to a first embodiment of the present invention.

As shown in FIG. 1, a front housing member 11 is connected to the front end of a cylinder block 12. A rear housing member 13 is connected to the rear end of the cylinder block 12 through a valve plate assembly 14. The front housing member 11, the cylinder block 12 and the rear housing member 13 are fastened together with through-bolts (not shown). The front housing member 11, the cylinder block 12 and the rear housing member 13 form a housing of the compressor. The left side and the right side in FIG. 1 correspond to the front end and the rear end, respectively.

The valve plate assembly 14 includes a main plate 14*a*, a first sub plate 14*b*, a second sub plate 14*c* and a retainer plate 14*d*. The first sub plate 14*b* and the second sub plate 14*c* are superposed on the front side and on the rear side of the main plate 14*a*, respectively. The retainer plate 14*d* is superposed on the rear side of the second sub plate 14*c*. The first sub plate 14*b* of the valve plate assembly 14 is connected to the cylinder block 12.

A crank chamber 15 is defined between the front housing member 11 and the cylinder block 12. A drive shaft 16 passes through the crank chamber 15. The drive shaft 16 is supported between the front housing member 11 and the cylinder block 12, and the front end of the drive shaft 16 extends from the housing. The front end of the drive shaft 16 is supported in the front housing member 11 by a first radial bearing 17. A holding bore 18 is defined substantially at the center of the cylinder block 12. The rear end of the drive shaft 16 is supported by a second radial bearing 19 located in the holding bore 18. A shaft sealing device 20 is applied around the front end of the drive shaft 16. The device 20 prevents leakage of refrigerant.

A plurality of cylinder bores 12*a* (only one cylinder bore is shown in FIG. 1) are defined in the cylinder block 12. The cylinder bores 12*a* are defined at equiangular intervals around the axis L of the drive shaft 16. Single-headed pistons 21 are housed in the cylinder bores 12*a*. Openings of each cylinder bore 12*a* are closed by the valve plate assembly 14 and the corresponding piston 21. A compression chamber 22 is defined in each cylinder bore 12*a*. The volume of each compression chamber 22 varies as the corresponding piston 21 reciprocates.

In the crank chamber 15, a lug plate 23 is fixed to and rotates integrally with the drive shaft 16. A thrust bearing 24 is located between the lug plate 23 and the internal wall surface 11*a* of the front housing member 11. The internal wall surface 11*a* bears the load of the compressive reaction force of the pistons 21 and functions as a regulating surface that regulates axial movement of the drive shaft 16.

A swash plate 25, or drive plate, is housed in the crank chamber 15. The swash plate 25 is supported such that it slides and on and inclines with respect to the drive shaft 16. A hinge mechanism 26 is located between the lug plate 23 and the swash plate 25. The swash plate 25 is connected to the lug plate 23 through the hinge mechanism 26 and to the drive shaft 16. The swash plate 25 rotates synchronously with the lug plate 23 and the drive shaft 16.

The pistons 21 are connected to the periphery of the swash plate 25 through shoes 27, respectively. Thus, the swash plate 25 is rotated by the drive shaft 16, and the rotational motion of the swash plate 25 is converted to reciprocating motions of the pistons 21 through the shoes 27.

A regulating ring 28 is fitted to the drive shaft 16 between the swash plate 25 and the cylinder block 12. The minimum inclination angle of the swash plate 25, as indicated by the broken double-dashed line in FIG. 1, is determined by abutment of the swash plate 25 against the regulating ring 28. The maximum inclination angle of the swash plate 25, as indicated by the solid line in FIG. 1, is determined by abutment against the lug plate 23.

The drive shaft 16 is connected to an engine 30 through a power transmission mechanism 29. The power transmission mechanism 29 may be a clutch mechanism (e.g., a solenoid clutch), which transmits or interrupts of power according to an external electrical controller, or a normally transmitting type clutchless mechanism (e.g., a belt/pulley combination). Here, in this embodiment, a clutchless power transmission mechanism 29 is employed.

A suction chamber 31 is defined in the rear housing member 13. A discharge chamber 32 is defined in the rear housing member 13 at a position radially outward from the suction chamber 31. The valve plate assembly 14 has, for each cylinder bore 12*a*, a suction port 33, a suction valve 34 for opening and closing the suction port 33, a discharge port 35 and a discharge valve 36 for opening and closing the discharge port 35. The suction chamber 31 communicates with the cylinder bores 12*a* through the suction ports 33. The discharge chamber 32 communicates with the cylinder bores 12*a* through the discharge ports 35. The suction chamber 31 and the discharge chamber 32 are connected to each other through an external refrigerant circuit (not shown).

The cylinder block 12 and the rear housing member 13 contain an gas supply passage 37 that connects the crank chamber 15 and the discharge chamber 32. A control valve 38, which is a solenoid valve, is located in the gas supply passage 37. The control valve 38 has a valve chamber forming part of the gas supply passage 37. Energization of a solenoid 38*a* opens the gas supply passage 37, and deenergization of the solenoid 38*a* closes the gas supply passage 37. Further, the opening degree of the gas supply passage 37 is adjusted depending on the level of the current energizing the solenoid 38*a*.

A holding space 40 is defined behind the holding bore 18. A restricting member 39 is housed in the holding space 40. The restricting member 39 restricts backward movement of the drive shaft 16. The holding space 40 is connected at one end the holding bore 18 and is closed at the other end by the valve plate assembly 14. The holding space 40 and the suction chamber 31 communicate with each other through a passage 41 defined in the valve plate assembly 14. The passage 41 is aligned with the axis L of the drive shaft 16.

The drive shaft 16 has an axial passage 42 that connects the holding space 40 and the crank chamber 15. An inlet 42*a* and an outlet 42*b* of the axial passage 42 open at the rear of the first radial bearing 17 and to the rear end face of the drive shaft 16, respectively. The axial passage 42, the holding bore 18, the holding space 40 and the passage 41 form a bleed passage for connecting the crank chamber 15 and the suction chamber 31. The passage 41 functions as a restrictor.

The restricting member 39, which is a cylindrical, is fixed to the rear end of the drive shaft 16. The restricting member 39 is designed to have an outside diameter that is smaller than the inside diameter of the second radial bearing 19, and the restriction member 39 is fixed to a small-diameter portion 16*a* formed at the rear end of the drive shaft 16.

Figure 2A:
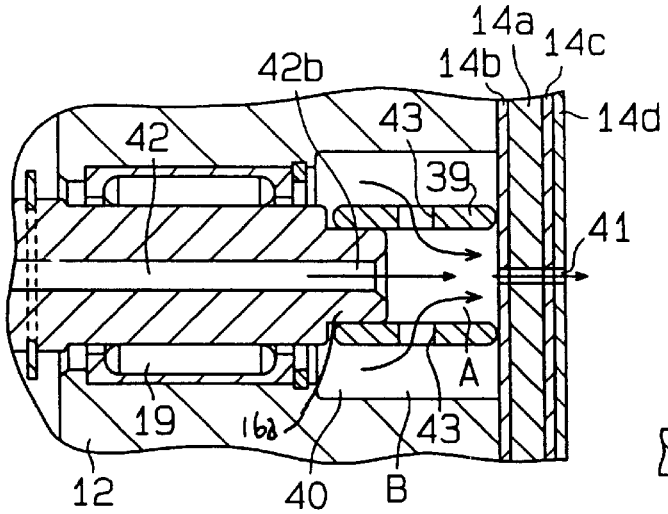
FIG. 2(*a*) is an enlarged partial cross-sectional view of the compressor shown in FIG. 1.
Figure 2B:
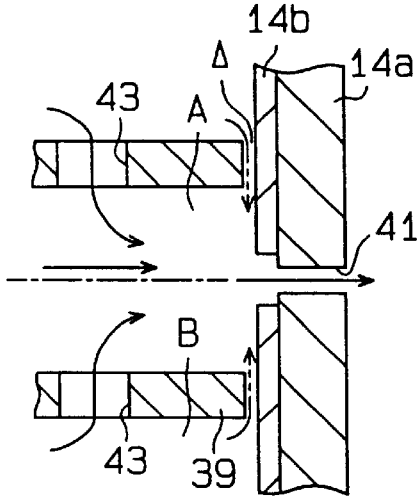

As shown in FIG. 2(*b*), in a normal compressing operation, a small clearance Δ is defined between the restricting member 39 and the valve plate assembly 14. When the internal pressure of the crank chamber 15 is increased suddenly, the clearance Δ disappears, and backward movement of the drive shaft 16 is restricted. The clearance Δ is, for example, about 0.1 mm. This clearance Δ is smaller than the clearance between the piston 21 at the top dead center position and the valve plate assembly 14.

As shown in FIGS. 2(*a*) and 2(*b*), the restricting member 39 divides the holding space 40 into a first region A and a second region B. The resistance of the refrigerant gas passing from the second region B to the first region A through the clearance Δ is greater than the resistance of the refrigerant gas flowing from the crank chamber 15 through the second radial bearing 19 into the holding space 40.

A plurality of holes 43 are defined in the restricting member 39 to form passages connecting the first region A and the second region B. The holes 43 are defined such that the resistance of the refrigerant gas passing through is smaller than that passing through the second radial bearing 19.

The operation of the compressor described above will be described below.

When the drive shaft 16 is rotated, the swash plate 25 is rotated integrally through the lug plate 23 and the hinge mechanism 26, and the rotation of the swash plate 25 is converted into reciprocating motion of the pistons 21 through the shoes 27. Consequently, suction, compression and discharge of the refrigerant are repeated sequentially in each compression chamber 22. Refrigerant supplied from an external refrigerant circuit into the suction chamber 31 is drawn through the suction port 33 into the compression chamber 22. Travel of the piston 21 to the top dead center compresses the refrigerant in the compression chamber 22 to a predetermined pressure and discharges the compressed refrigerant through the discharge port 35 into the discharge chamber 32. The refrigerant discharged into the discharge chamber 32 is fed through a discharge passage to the external refrigerant circuit.

A controller (not shown) adjusts the valve position of the control valve 38, i.e., the opening degree of the gas supply passage 37, depending on the cooling load. As a result, the flow rate of gas between the discharge chamber 32 and the crank chamber 15 is changed.

When the cooling load is high, the opening degree of the gas supply passage 37 is reduced to reduce the flow rate of the refrigerant gas supplied from the discharge chamber 32 into the crank chamber 15. When the amount of refrigerant gas supplied to the crank chamber 15 decreases, the internal pressure of the crank chamber 15 is reduced gradually due to the release of refrigerant gas through the axial passage 42 into the suction chamber 31. Thus, the differential pressure between the pressure of the crank chamber 15 and that of the cylinder bore 12*a* decreases, which moves the swash plate 25 to the maximum inclination position. Therefore, the stroke of the piston 21 is increased, which increases the displacement.

When the cooling load is low, the control valve 38 is opened to increase the flow rate of refrigerant gas from the discharge chamber 32 into the crank chamber 15. If the amount of refrigerant gas supplied to the crank chamber 15 exceeds the flow rate of refrigerant gas flowing out through the axial passage 42 into the suction chamber 31, the internal pressure of the crank chamber 15 increases gradually. Thus, the differential pressure between the crank chamber 15 and the cylinder bore 12*a* increases, which moves the swash plate 25 to the minimum inclination angle position. This reduces the stroke of each piston 21, and reduces the displacement.

The compression load of the refrigerant gas acting upon each piston 21 is applied to the internal wall surface 11*a* of the front housing member 11 through the shoes 27, the swash plate 25, the hinge mechanism 26, the lug plate 23 and the thrust bearing 24. Generally, in the compressing operation, forward movement of the drive shaft 16, the swash plate 25, the lug plate 23, and the pistons 21 along the axis L is restricted by the internal wall surface 11*a* of the front housing member 11 through the thrust bearing 24. When the wall surface 11*a* restricts the forward axial movement of the drive shaft 16, a clearance Δ exists between the restricting member 39 and the valve plate assembly 14. Accordingly, the restricting member 39 does not interfere with the rotation of the drive shaft 16.

When the compressor is operating at the maximum displacement and is subjected to displacement restricting control, the control valve 38 causes the gas supply passage 37 to open suddenly from a closed state. Thus, the high-pressure refrigerant in the discharge chamber 32 is supplied rapidly to the crank chamber 15. The pressure of the crank chamber 15 increases rapidly, since additional refrigerant can not be rapidly through the axial passage 42. The sudden increase in the pressure of the crank chamber 15 rapidly reduces the inclination angle of the swash plate 25. This causes the swash plate 25 (indicated by the broken double-dashed line in FIG. 1) to be pressed against the regulating ring 28 with an excessive force, which pulls the lug plate 23 strongly backward through the hinge mechanism 26. Thus, the drive shaft 16 slides backward along the axis L. The restricting member 39 thus abuts against the valve plate assembly 14 to restrict backward movement of the drive shaft 16. Therefore, the distal end of the piston 21 is prevented from connecting the valve plate assembly when the piston 21 reaches the top dead center position.

During rotation of the drive shaft 16, some refrigerant flows from the passage 41 into the suction chamber 31 through the axial passage 42 and the holding space 40 due to the differential pressure between the crank chamber 15 and the suction chamber 31. Atomized lubricant in the refrigerant lubricates the thrust bearing 24 and the first radial bearing 17.

Some of the refrigerant gas in the crank chamber 15 flows through the second radial bearing 19 into the second region B of the holding space 40. The second radial bearing 19 is lubricated by the atomized lubricant contained in the refrigerant flowing from the crank chamber 15 toward the holding space 40. During normal operation of the compressor, there is a very small clearance Δ present between the restricting member 39 and the valve plate assembly 14. If the second region B and the first region A could communicate with each other only through the clearance Δ, the refrigerant would not move smoothly from the second region B to the first region A. Thus, the amount of refrigerant passing through the second radial bearing 19 would decrease and the second radial bearing 19 would not be adequately lubricated. Particularly, in the case of clutchless compressors, the second radial bearing 19 is lubricated insufficiently during minimum displacement operation.

However, in this embodiment, the restricting member 39 includes the holes 43, and the refrigerant thus passes from the second region B to the first region A smoothly. As a result, the refrigerant flowing from the crank chamber 15 toward the holding space 40 through the second radial bearing 19 thoroughly lubricates the second radial bearing 19.

This embodiment has the following effects.

A reduction in the amount of refrigerant passing through the second radial bearing 19 is avoided by forming holes 43 between the first region A and the second region B. Thus, impingement of the pistons 21 against the valve plate assembly 14 caused by backward movement of the drive shaft 16 is avoided, even in the absence of the spring 113 shown in FIG. 8. Further, the second radial bearing 19 is thoroughly lubricated. In addition, the load acting upon the thrust bearing 24 is reduced compared with constitution compressors that employ the spring 113. This reduces friction and thus reduces the power loss of the compressor, which improves the fuel consumption of the engine 30. The present invention has a particularly significant effect in clutchless compressors.

Use of the restricting member 39 in which holes 43 are formed permits thorough lubrication of the second radial bearing 19 and restricts backward movement of the drive shaft 16. The number and the diameter of the holes 43 can be changed arbitrarily.

The restricting member 39 is fitted on the drive shaft 16. Therefore, the assembly is simple.

The outside diameter of the restricting member 39 is smaller than the inside diameter of the second radial bearing 19. Therefore, during assembly of the compressor, the restricting member 39 can be installed in the compressor after it is fitted on the drive shaft 16. This facilitates assembly.

Figure 8:
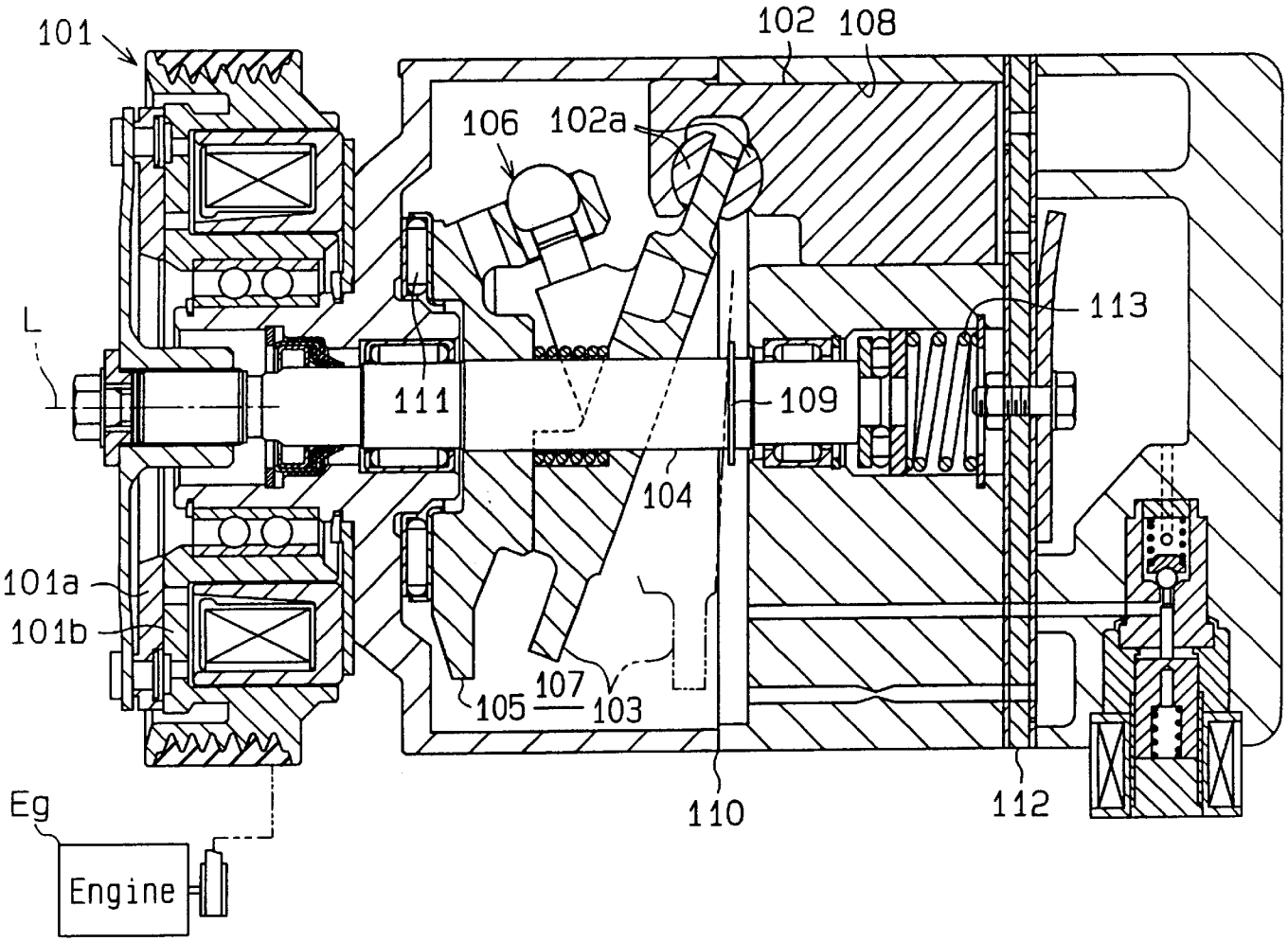
Fig.8 (Prior Art)
FIG. 8 is a cross-sectional view of a variable displacement compressor of the prior art.

The holding space 40 is located between the holding bore 18 and the valve plate assembly 14. Therefore, the space used for housing the spring 113 shown in FIG. 8 is used as the holding space 40. Thus, space for the restricting member 39 is available, and there is no need to enlarge the compressor.

A second embodiment will be described referring to FIGS. 3(*a*) to 4. This embodiment has the same construction as in the embodiment shown in FIGS. 1 to 2(*b*), except that the passages between the second region B and the first region A are different from that in the foregoing embodiment. Therefore, the same or like parts as in the embodiment shown in FIGS. 1 to 2(*b*) are affixed with the same reference numbers respectively, and a detailed description of them will be omitted.

A cross-shaped hole 44 is defined in the first sub plate 14*b* of the valve plate assembly 14. The hole 44 is defined when forming of the suction valve 34 by using different press dies.

Figure 4:
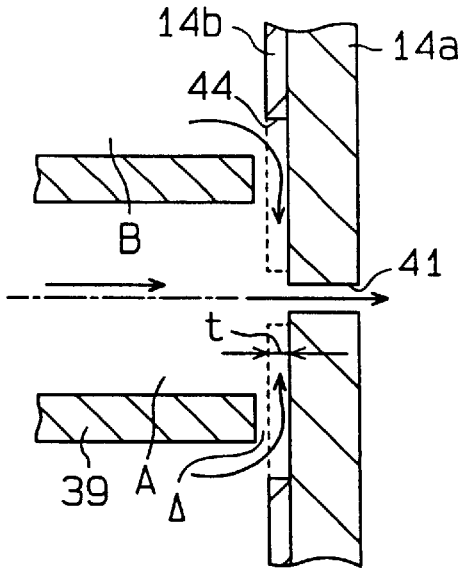
FIG. 4 is an enlarged cross-sectional view showing actions of the passage at the portion shown in FIG. 3(*a*)

As shown in FIG. 4, the clearance between the restricting member 39 and the valve plate assembly 14 corresponds to the clearance Δ shown in FIG. 2(*b*). The size of the clearance between opposing parts of the restricting member 39 and the hole 44 is the sum of the clearance Δ and the thickness t of the first sub plate 14*b*. The refrigerant flows smoothly from the second region B into the first region A through this clearance Δ+t).

This embodiment has the following effects in addition to those of the embodiment shown in FIGS. 1 to 2(*b*).

The hole 44 can be defined simultaneously when the first sub plate 14*b* is formed by slightly changing the dies used for forming the first sub plate 14*b*. Further, the passage between the second region B and the first region A can be defined easily, which reduces costs compared with the case where the holes 43 are defined in the restricting member 39 by drilling or the like.

This embodiment may be modified as follows.

If the passage connecting the second region B and the first region A is defined in the valve plate assembly 14, both the first sub plate 14*b* and the main plate 14*a* may be machined. For example, as in a third embodiment shown in FIGS. 5(*a*), 5(*b*) and 6, a circular first hole 45 and a plurality of second holes (four holes in this embodiment) 46 are defined in the first sub plate 14*b*. The first hole 45 is defined concentrically with the passage 41 and has a diameter smaller than the inside diameter of the restricting member 39. The second hole 46 is defined radially outside of the restricting member 39.

Figure 5A:
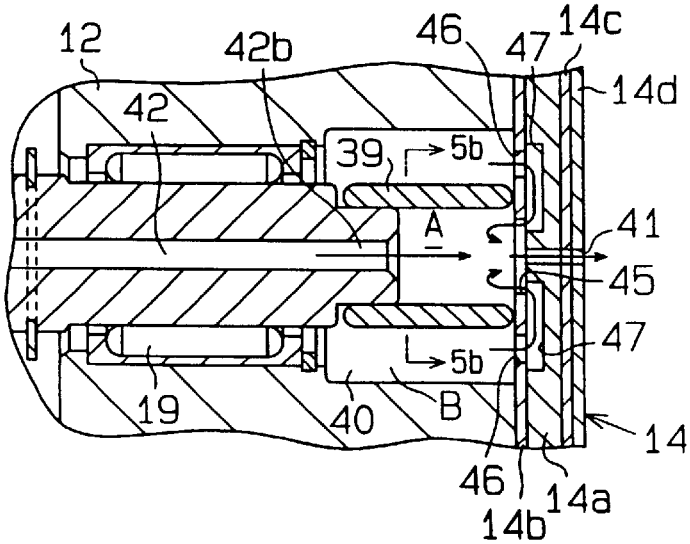
FIG. 5(*a*) is an enlarged cross-sectional view of the compressor according to a third embodiment of the present invention, showing a portion corresponding to that in FIG. 2(*a*)
Figure 5B:
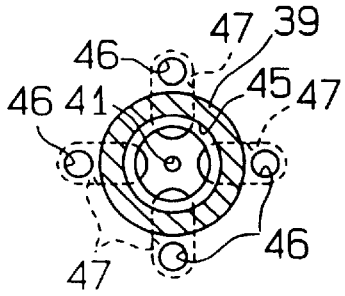
Figure 6:
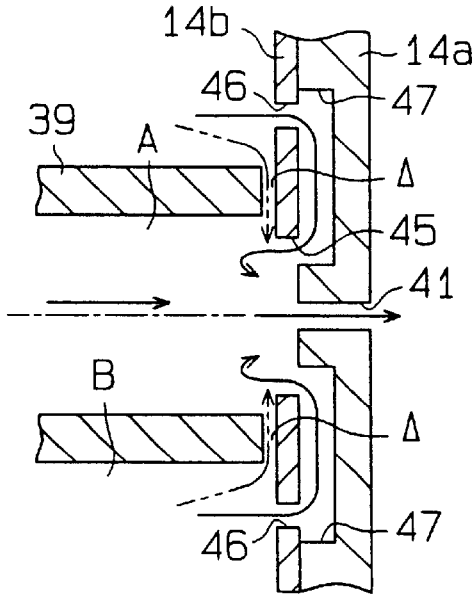
FIG. 6 is an enlarged cross-sectional view showing actions of the passage at the portion shown in FIG. 5(*a*)

As shown in FIGS. 5(*a*) and 5(*b*), four elliptic recesses 47 are defined in the main plate 14*a*. The recesses 47 connect the first hole 45 to the second holes 46. In this embodiment, the first hole 45, the second holes 46 and the recesses 47 define the passage between the second region B and the first region A. The first hole 45 and the second holes 46 are formed when the suction valve 34 is formed in the first sub plate 14*b*, and the recesses 47 are formed when forming the suction ports 33, discharge ports 35, etc. in the main plate 14*a*. Therefore, this embodiment has the same effects as in the embodiment shown in FIGS. 3(*a*) to 4.

Figure 3A:
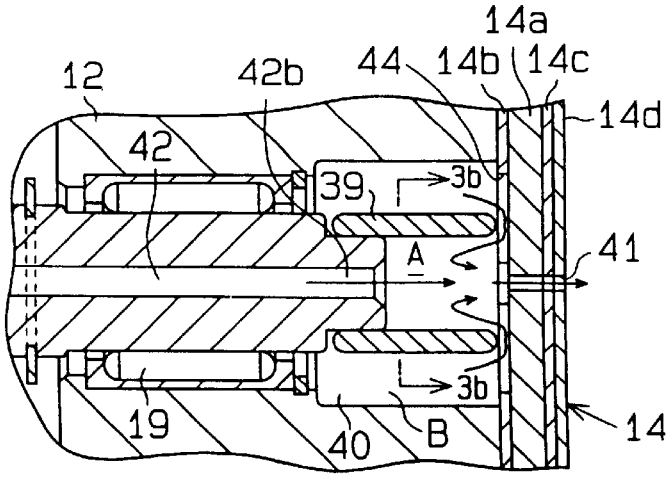
FIG. 3(*a*) is an enlarged partial cross-sectional view of the compressor according to a second embodiment of the present invention, showing a portion corresponding to that in FIG. 2(*a*)
Figure 3B:
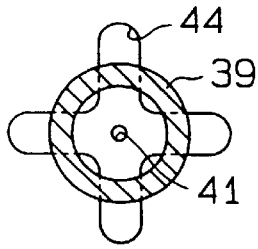

In the embodiment shown in FIGS. 3(*a*) to 4, in the state where the restricting member 39 is abutted against the valve plate assembly 14, the end face of the restricting member 39 is brought into direct contact with the periphery of the hole 44. In the embodiment shown in FIGS. 5(*a*), 5(*b*) and 6, in the state where the restricting member 39 is abutted against the valve plate assembly 14, the restricting member 39 is not engaged with the passage defined in the valve plate assembly 14.

Instead of fitting the restricting member 39 to the small-diameter rear end portion of the drive shaft 16, the diameter of the outlet 42*a* of the axial passage 42 may be increased so that the restricting member 39 can be fitted in the axial passage 42. In this case, the effects of the embodiments shown in FIGS. 1 to 6 can be obtained.

The passage between the second region B and the first region A may be defined in the drive shaft 16.

The restricting member 39 may be formed integrally at the rear end portion of the drive shaft 16. That is, the rear end of the drive shaft 16 is abutted directly against the valve plate assembly 14, and a hole 43 is defined in the rear end of the drive shaft 16.

The cylindrical restricting member 39 may be press fitted in the holding space 40. For example, as in a fourth embodiment shown in FIG. 7(*a*), in the state where the drive shaft 16 is urged forward by the compressive reaction force, the restricting member 39 is fixed such that a clearance Δ is defined between the restricting member 39 and the rear end of the drive shaft 16. The restricting member 39 is fixed in the holding space 40 such that a sufficient distance exists between the valve plate assembly 14 and the restricting member 39.

A first hole 48 is defined at the center of the restricting member 39. A plurality of second holes 49 are defined as passages between the second region B and the first region A. This eliminates the need for fixing the restricting member 39 to the drive shaft 16 and for machining the valve plate assembly 14, and only the restricting member 39 is machined.

Figure 7A:
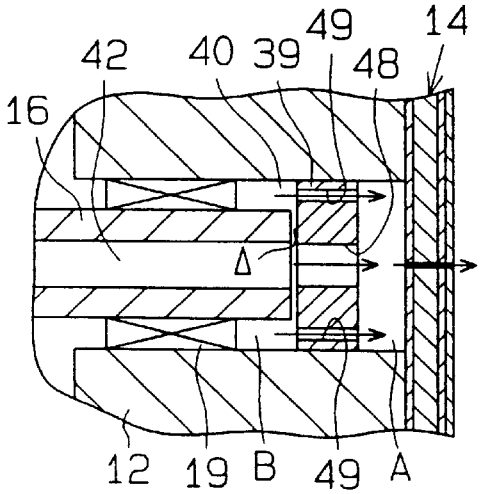
FIG. 7(*a*) is an enlarged cross-sectional view of the compressor according to a fourth embodiment of the present invention, showing a portion corresponding to that in FIG. 2(*a*)
Figure 7B:
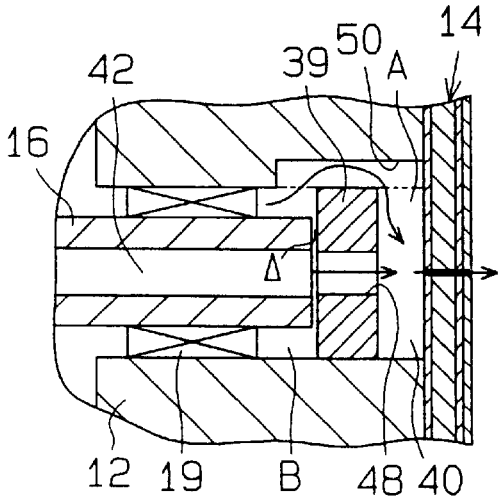

In a fifth embodiment shown in FIG. 7(*b*), a groove 50 is formed as the passage in the cylinder block 12. In this case, the degree of freedom in the size of the passage is increased compared with the embodiments where the passage is defined in the restricting member 39, and the groove 50 can be formed when forming the cylinder block 12, which simplifies the formation the restricting member 39.

The axial passage 42 need not be defined in the drive shaft 16, but a bleed passage (not shown) may be defined separately in the cylinder block 12. In this case, the holding space 40 is allowed to communicate with the suction chamber 31 to permit flow of the refrigerant into it and to lubricate the second radial bearing 19.

The present invention may be employed where power transmission from the drive source to the drive shaft 16 is achieved through a solenoid clutch. In this case, the clearance defined between the rotor of the solenoid clutch and the armature, when the solenoid is off, is larger than the clearance Δ between the restricting member 39 and the valve plate assembly 14 or between the restricting member 39 and the rear end face of the drive shaft 16. Therefore, even if the value of clearance Δ is not changed, the rotor and the armature do not interfere with each other when the solenoid clutch is off.

The present invention may be applied to a wobble compressor in which the drive plate rotates relative to the drive shaft.

The control valve 38 for adjusting the opening degree of the air supply passage is not limited to the solenoid valve. The control valve 38 may be, for example, one disclosed in Japanese Unexamined Patent Publication No. Hei 6-123281, which has a diaphragm that moves according to the suction pressure and a valve mechanism for controlling the opening degree of the air supply passage according to the position of the diaphragm. However, an externally controllable solenoid valve is preferred in a clutchless compressor.

The drive source is not limited to the engine 30 but may be a motor.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive, and the invention is not to be limited to the details given herein, but may be modified within the scope of the appended claims.

What is claimed is:

1. A variable displacement compressor comprising:

a housing having a suction chamber and a discharge chamber;

a crank chamber defined in the housing;

a drive shaft having a front end and a rear end, the shaft being supported in the housing so that the front end protrudes from the housing;

a cylinder block forming part of the housing, wherein cylinder bores are defined in the cylinder block;

a valve plate assembly, which includes a suction port, a suction valve, a discharge port and a discharge valve for each cylinder bore;

single-headed pistons housed in the cylinder bores, respectively;

a drive plate, which is housed in the crank chamber and is connected to the pistons to convert rotation of the drive shaft into reciprocating motion of the pistons, wherein the drive plate rotates integrally with the drive shaft;

a control mechanism, which controls inclination of the drive plate by controlling the pressure of the crank chamber to change the volume of a refrigerant discharged from each cylinder bore into the discharge chamber;

a radial bearing supporting the rear end of the drive shaft, wherein the refrigerant flows through the radial bearing;

a holding bore, in which the rear end of the drive shaft and the radial bearing are located, wherein the holding bore is connected to a holding space, and the holding space is defined by the valve plate assembly;

a passage connecting the holding space and the suction chamber; and a restricting member located in the holding space, wherein the restricting member divides the holding space into a first region and a second region, and the first region and the second region communicate with each other, wherein a clearance is formed between the drive shaft and the restricting member or between the restricting member and the valve plate assembly in a normal compressing operation, wherein the restricting member restricts the movement of the drive shaft, which movement would be equal to or greater than the clearance if there were no restriction of the movement, and the clearance disappears when the pressure of the crank chamber is increased rapidly by the control mechanism.

2. The variable displacement compressor according to claim 1, wherein the resistance of the refrigerant when it passes from the first region to the second region is less than that when the refrigerant passes through the radial bearing.

3. The variable displacement compressor according to claim 1, wherein the restricting member has a cylindrical shape, and one end of the restricting member is fixed to the drive shaft, and the other end of the restricting member abuts against the valve plate assembly.

4. The variable displacement compressor according to claim 3, wherein a passage is defined in the valve plate assembly to connect the first region and the second region.

5. The variable displacement compressor according to claim 4, wherein the valve plate assembly has a first sub plate, a second sub plate and a main plate, wherein the main plate is located between the first and second subplates, and the passage is defined in the first sub plate.

6. The variable displacement compressor according to claim 4, wherein the valve plate assembly has a first sub plate, a second sub plate and a main plate, wherein the main plate is located between the first and the second subplates, and the passage is defined in the main plate and the first sub plate.

7. The variable displacement compressor according to the claim 1, wherein a hole is defined in the restricting member to connect the first region to the second region.

8. The variable displacement compressor according to claim 1, wherein the restricting member is press fitted into the holding space such that a predetermined clearance exists between the restricting member and the valve plate assembly.

9. The variable displacement compressor according to claim 8, wherein a passage is defined in the cylinder block between the first and the second region.

10. The variable displacement compressor according to claim 1, wherein the clearance is smaller than a clearance between the piston at the top dead center position and the valve plate assembly.

11. A variable displacement compressor comprising:

a housing having a suction chamber and a discharge chamber;

a crank chamber defined in the housing;

a drive shaft having a front end and a rear end, the shaft being supported in the housing so that the front end protrudes from the housing;

a cylinder block forming part of the housing, wherein cylinder bores are defined in the cylinder block;

a valve plate assembly, which includes a suction port, a suction valve, a discharge port and a discharge valve for each cylinder bore;

single-headed pistons housed in the cylinder bores, respectively;

a drive plate, which is housed in the crank chamber and is connected to the pistons to convert rotation of the drive shaft into reciprocating motion of the pistons, wherein the drive plate rotates integrally with the drive shaft;

a control mechanism, which controls inclination of the drive plate by controlling the pressure of the crank chamber to change the volume of a refrigerant discharged from each cylinder bore into the discharge chamber;

a radial bearing supporting the rear end of the drive shaft, wherein the refrigerant flows through the radial bearing;

a holding bore, in which the rear end of the drive shaft and the radial bearing are located, wherein the holding bore is connected to a holding space, and the holding space is defined by the valve plate assembly, wherein the holding space is connected to the suction chamber;

means for restricting being located in the holding space, and divide the holding space into a first region and a second region, wherein a clearance is formed between the drive shaft and the restricting means or between the restricting means and the valve plate assembly in a normal compressing operation, wherein the restricting means restricts the movement of the drive shaft, which movement would be equal to or greater than the clearance if there were no restriction of the movement, and the clearance disappears when the pressure of the crank chamber is increased rapidly by the control mechanism; and a passage connecting the first region to the second region.

12. The variable displacement compressor according to claim 11, wherein the clearance is smaller than a clearance between the piston at the top dead center position and the valve plate assembly.

13. A variable displacement compressor comprising;

a housing having a suction chamber and a discharge chamber;

a crank chamber defined in the housing;

a drive shaft having a front end and a rear end, the shaft being supported in the housing so that the front end protrudes from the housing;

a cylinder block forming part of the housing, wherein cylinder bores are defined in the cylinder block;

a valve plate assembly, which includes a suction port, a suction valve, a discharge port and a discharge valve for each cylinder bore;

single-headed pistons housed in the cylinder bores, respectively;

a drive plate, which is housed in the crank chamber and is connected to the pistons to convert rotation of the drive shaft into reciprocating motion of the pistons, wherein the drive plate rotates integrally with the drive shaft;

a control mechanism, which controls inclination of the drive plate by controlling the pressure of the crank chamber to change the volume of a refrigerant discharged from each cylinder bore into the discharge chamber;

a radial bearing supporting the rear end of the drive shaft, wherein the refrigerant flows through the radial bearing;

a holding bore, in which the rear end of the drive shaft and the radial bearing are located, wherein the holding bore is connected to a holding space, and the holding space is defined by the valve plate assembly;

a passage connecting the holding space and the suction chamber; and a cylindrical body located in the holding space, wherein one end of the cylindrical body is fixed to the drive shaft, and the other end of the cylindrical body abuts against the valve plate assembly, wherein the cylindrical body divides the holding space into a first region and a second region, wherein the cylindrical body has a hole to connect the first region to the second region, wherein a clearance is formed between the drive shaft and the cylindrical body or between the cylindrical body and the valve plate assembly in a normal compressing operation, wherein the cylindrical body restricts the movement of the drive shaft, which movement would be equal to or greater than the clearance if there were no restriction of the movement, and the clearance disappears when the pressure of the crank chamber is increased rapidly by the control mechanism.

14. The variable displacement compressor according to claim 13, wherein the clearance is smaller than a clearance between the piston at the top dead center position and the valve plate assembly.

* * * * *